US010143630B2

(12) United States Patent
Yang et al.

(10) Patent No.: US 10,143,630 B2
(45) Date of Patent: Dec. 4, 2018

(54) DEVICE AND METHOD FOR GUIDING LATCH-ON

(75) Inventors: Aizhi Yang, Shanghai (CN); Renjun Yu, Shanghai (CN); Xin Chen, Shanghai (CN); Axelle Stephanie Maud Ducos, London (GB)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 830 days.

(21) Appl. No.: 13/996,566

(22) PCT Filed: Dec. 19, 2011

(86) PCT No.: PCT/IB2011/055787
§ 371 (c)(1),
(2), (4) Date: Sep. 26, 2013

(87) PCT Pub. No.: WO2012/090117
PCT Pub. Date: Jul. 5, 2012

(65) Prior Publication Data

US 2014/0008317 A1 Jan. 9, 2014

(30) Foreign Application Priority Data

Dec. 31, 2010 (WO) ..... PCT/CN2010/080630

(51) Int. Cl.
*A61J 13/00* (2006.01)
*A61J 11/00* (2006.01)

(52) U.S. Cl.
CPC ..... *A61J 13/00* (2013.01); *A61J 11/00* (2013.01); *A61J 11/0035* (2013.01)

(58) Field of Classification Search
CPC ..... A61J 13/00; A61J 11/00; A61J 11/0035; A61J 11/004; A61J 11/0045; A61J 11/007;
(Continued)

(56) References Cited

U.S. PATENT DOCUMENTS 2,054,491 A * 9/1936 Tynan ..... A61F 13/141 604/346
5,732,714 A 3/1998 Morrissey et al.
(Continued)

FOREIGN PATENT DOCUMENTS

CN 1725999 A 1/2006
DE 4415939 C1 1/1996
(Continued)

OTHER PUBLICATIONS

Machine Translation of description of WO2011012228 A1, translated on Feb. 12, 2016, via Patent Translate on http://worldwide.espacenet.com/, pp. 1-20.*
(Continued)

*Primary Examiner* — Bhisma Mehta
*Assistant Examiner* — Melissa A Snyder

(57) ABSTRACT

The invention proposes a device (1) and a corresponding method, wherein the device (1) comprises: a first element (10) to be attached to a breast of a breastfeeding mother; and a first marker (11) located on the outer surface (100) of the first element (10), wherein the first marker (11) is used for indicating a position of a mother's breast that the baby's lip is expected to contact in order to correctly hold the mother's breast. With the device (1) attached to the mother's breast, the first marker (11) indicates a position that the baby's lip is expected to contact, and the breastfeeding mother can have a clear view of whether the baby correctly holds the mother's breast according to the distance between the first marker (11) and the baby's lip.

11 Claims, 3 Drawing Sheets

(58) Field of Classification Search
CPC ..... A61J 7/0046; A61J 7/0053; A61F 13/14; A61F 2013/150162; A61M 1/062; A61M 1/064; A61M 1/066; A61M 1/068
USPC ..... D24/199, 196
See application file for complete search history.

(56) References Cited

U.S. PATENT DOCUMENTS

| | | | | |
|---|---|---|---|---|
| 5,919,180 | A | 7/1999 | Raimondo | |
| 6,074,272 | A * | 6/2000 | Hebert | A61F 13/141 450/37 |
| 7,487,779 | B2 * | 2/2009 | Kurz | A61F 15/008 128/889 |
| 8,770,202 | B2 | 7/2014 | Rohrig | |
| 2003/0014108 | A1 | 1/2003 | Lauren | |
| 2004/0182813 | A1 | 9/2004 | Gilmore | |
| 2004/0220618 | A1 * | 11/2004 | Rohrig | A61J 11/0035 606/234 |
| 2005/0177099 | A1 | 8/2005 | Dahan et al. | |
| 2006/0157065 | A1 * | 7/2006 | Rohrig | A61J 13/00 128/890 |
| 2008/0319479 | A1 * | 12/2008 | Murphy Matro | A61J 17/001 606/234 |
| 2009/0194116 | A1 | 8/2009 | Pacini | |
| 2009/0283101 | A1 | 11/2009 | Mans | |
| 2009/0286452 | A1 | 11/2009 | Grayson | |

FOREIGN PATENT DOCUMENTS

| | | | | |
|---|---|---|---|---|
| DE | 10138039 | A1 | 5/2002 | |
| DE | 20219950 | U1 | 3/2003 | |
| EP | 2284500 | A1 | 2/2011 | |
| FR | 2880800 | A1 | 7/2006 | |
| JP | 3120392 | U | 3/2006 | |
| WO | 2004054495 | A1 | 7/2004 | |
| WO | WO 2011012228 | A1 * | 2/2011 | A61B 5/4288 |

OTHER PUBLICATIONS

Merriam-Webster. Merriam-Webster, n.d. Web. Sep. 9, 2016. <http://www.merriam-webster.com/dictionary/distal>.*

* cited by examiner

DEVICE AND METHOD FOR GUIDING LATCH-ON

FIELD OF THE INVENTION

The present invention relates to breast feeding, particularly to a device and a method for guiding a correct latch-on position for a breastfeeding mother.

BACKGROUND OF THE INVENTION

When a baby's lips are stimulated with the nipple, the baby turns its head in the direction of the nipple and opens its mouth wide with its tongue at the bottom of the mouth. The wide-open mouth of the baby can be used to insert as much of the breast as possible into the baby's mouth. A correct latch-on means that nipple, areola (which is the circular area such as the colored skin surrounding the nipple), and underlying breast tissue are drawn deeply into the baby's mouth. And the baby's upper and lower lips should be turned out, in other words, the baby's upper and lower lips are everted.

During normal suckling, the baby uses negative pressure to attach to the breast, draw the nipple and areola into its mouth to make a seal, and uses positive pressure to stimulate the breast; as a result, the negative pressure and positive pressure together draw the milk out of the breast. When a large piece of breast has been taken into the mouth, the nipple is essentially free from frictional movement against surfaces in the mouth.

When the baby has an inadequate amount of tissue in its mouth, for example, the baby only has the nipple in its mouth, the teat does not extend well into the mouth, but is drawn in and out of the mouth, causing friction against the tongue and gums, resulting in frictional damage of the nipple such as a sore or cracked nipple. At the same time, the incorrect latch-on also causes inadequate stimulation to the nipple and areola of the breastfeeding mother and the milk removal effectiveness and efficiency is influenced as a result. Besides, the baby's suck reflex is not stimulated properly and as a result he/she does not receive enough nutrients during feeding.

If the baby is latched onto the breast correctly, the mother is less likely to feel nipple pain, and the baby is likely to get more milk as the baby compresses the areola beneath which the milk sinuses, in other words, the reservoirs for milk, are located.

SUMMARY OF THE INVENTION

The breastfeeding mother, in particular the first time mother, has little experience in making the baby latch onto the breast correctly. Besides, during breastfeeding, mothers have an impeded view of the lower part of the breast that contacts the baby's lower jaw and tongue. However, this area is critical for correct latch-on. Therefore, the occurrence of incorrect latch-on is common, which has a negative impact on breast feeding.

In view of the above issues, it would be advantageous to provide a technical solution that could guide the breastfeeding mother to achieve a correct latch-on position for the baby.

To better address the above concern, according to one embodiment of the invention, there is provided a device comprising:

a first element to be attached to a breast of a breastfeeding mother; and a first marker located on the outer surface of the first element, wherein the first marker is used for indicating a position of a mother's breast that the baby's lip is expected to contact in order to correctly hold the mother's breast.

With the device attached to the mother's breast, the first marker indicates a position that the baby's lip is expected to contact, and the breastfeeding mother can have a clear idea of whether the baby correctly holds the mother's breast according to the distance between the first marker and the baby's lip.

In another embodiment, the first marker may be located on the upper portion of the first element or on the lower portion of the first element.

In another embodiment, the device comprises two markers, namely the first marker and the second marker. In said embodiment, the first marker and the second marker are located on the lower portion and the upper portion respectively of the first element to indicate the positions of the mother's breast that the baby's lower lip and upper lip respectively are expected to contact, wherein the lower portion and the upper portion of the first element are to be attached to the lower portion and the upper portion of the breast, respectively.

With this embodiment, the positions indicated by the markers are used for guiding the baby's upper lip and/or lower lip relative to the mother's breast in order to correctly hold the mother's breast, which can help the mother to determine the position of the baby's upper lip and/or lower lip for correct latch-on.

In another embodiment, the marker on the upper portion of the first element may be a visible marker or a tactile marker, and the marker on the lower portion of the first element may be a tactile marker.

On the one hand, a breastfeeding mother has a poor view of the lower portion of her breast. With the marker on the lower portion of the first element being tactile, the mother can easily touch the marker to determine the correct latch-on position for the baby's lower lip. On the other hand, the mother is able to see the upper portion of her breast; therefore, a visible marker is sufficient for her to determine the correct latch-on position for the baby's upper lip. Besides, the upper marker and the lower marker are designed with different patterns to avoid the situation where the markers are upside-down when the breastfeeding mother wears the device.

In another embodiment, the tactile marker comprises at least one protuberance or dent. The at least one protuberance can take the form of protruding ribs, protruding knobs, or any other form that is tangible, while the at least one dent can take the form of grooves or concave spots or any other form that is tangible.

The visible marker for example comprises a colored line that can be seen clearly by the mother.

Preferably, the marker is formed to match the shape of the baby's lip, e.g. contour of the baby's lip, so as to provide the mother with an accurate reference for determining the location of the baby's lip, and provide the baby with a comfortable feeling.

In another embodiment, the distance range between a nipple of the breastfeeding mother and the marker is from 20 mm to 35 mm. It is recommended by the lactation consultant that the baby's mouth should cover approximately one inch of the areola behind the nipple. Therefore, the part of the areola that is 20 mm to 35 mm away from the nipple should be suckled by the baby's mouth for a correct latch-on.

In another embodiment, the first element is funnel-shaped, fan-shaped or strip-shaped. The funnel-shaped first element is easy to be worn on the mother's breast because its shape is similar to the shape of the breast of a mother. The fan-shaped or strip-shaped first element, however, is easy for packing and can save space.

In another embodiment, the device comprises a protruding portion covering a nipple of the breast, wherein the protruding portion has at least one aperture for releasing breast milk. The protruding portion can protect the mother's nipple from being damaged. In addition, this embodiment is particularly suitable for the mother who already has a sore or cracked nipple, and the protruding portion can protect her nipple from further abrasion. The protruding portion can help to place the device on the breast. With the aid of the protruding portion, the mother can wear the first element of the device in the correct position on the breast.

Advantageously, the shape of the protruding portion fits that of the nipple of the breast. Therefore, when the baby suckles the protruding portion of the device, it can hardly feel the difference between the protruding portion and the mother's breast, and after the removal of the device, the baby can easily return to the breast.

In another embodiment, the protruding portion is detachable from the device. The removal of the protruding portion enables the baby to contact as much as possible of the mother's breast directly, so that the breast is better stimulated, and as a result the breast can produce more milk.

In still another embodiment, the device further comprises a second element for attaching the first element to the breast. In one embodiment, the second element comprises a strap for attaching the first element to the breast. For example, the device can be worn on the breast of the mother in a manner similar to a bra.

In another embodiment, the inner surface of the first element has adhesive materials. The adhesive materials are to be attached to the breast of the breastfeeding mother.

In another embodiment, the device is made of adhesive material, such as silicone, latex or plastic. Such materials feel like the skin of the mother, and the baby will not refuse to contact the material and hence the suckling of the breast will not be influenced.

According to an embodiment of another aspect of the invention, there is provided a method comprising: attaching a device to a breast of a breastfeeding mother, wherein the device comprises a marker, which marker is used for indicating a position of the mother's breast that the baby's lip is expected to contact in order to correctly hold the mother's breast.

BRIEF DESCRIPTION OF THE DRAWING

The above and other features, aspects and advantages of the present invention will become obvious by reading the following description of non-limiting embodiments with reference to the appended drawings, in which.

Figure 1:
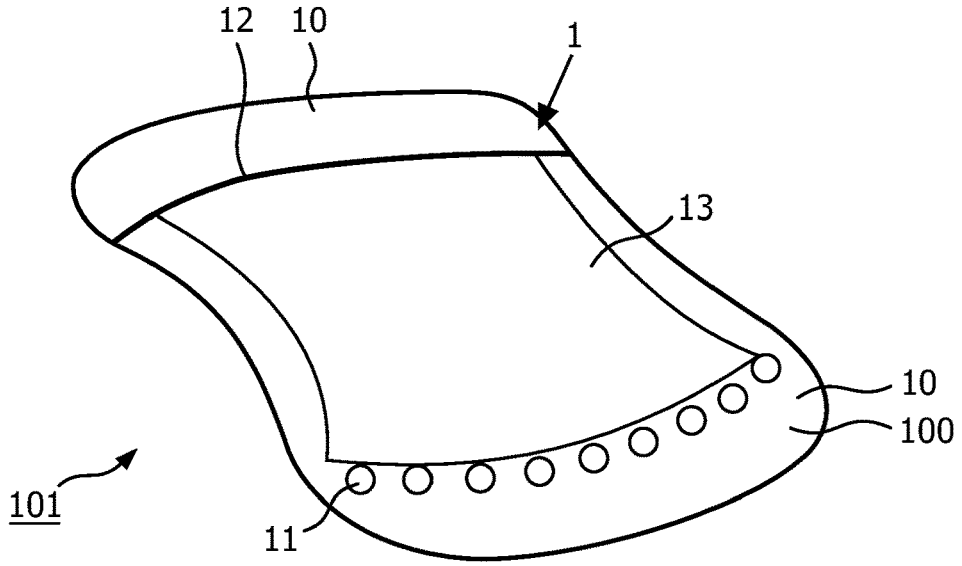
FIG. 1 shows a perspective view of the device according to an embodiment of the present invention.

In the drawings, same or similar reference signs refer to same or similar components.

DETAILED DESCRIPTION OF EMBODIMENTS

With reference to FIG. 1 to FIG. 6, the concept of the invention will be elucidated by describing the device and the method according to embodiments of the invention.

FIG. 1 shows a perspective view of the device 1 according to an embodiment of the present invention. The device 1 in FIG. 1 comprises a first element 10 to be attached to a breastfeeding mother's breast. A first marker 11 is located on the outer surface 100 of the first element 10, which first marker 11 is used for indicating a position of a mother's breast that the baby's lip is expected to contact in order to correctly hold the mother's breast. In other words, the first marker 11 is used for indicating, for the baby's lip, a position where the baby's lip is expected to be close to or located against the mother's breast when the baby holds the mother's breast for suckling the breast milk.

The first element 10 has an outer surface 100 and an inner surface 101. The outer surface 100 faces outwards when the device 1 is attached to the mother's breast; while the inner surface 101 faces inwards, i.e. faces the breast of the breastfeeding mother. In FIG. 1, the region 13 is a hollow, which allows the mother's nipple and part of the breast to contact the baby's lips directly.

Figure 2:
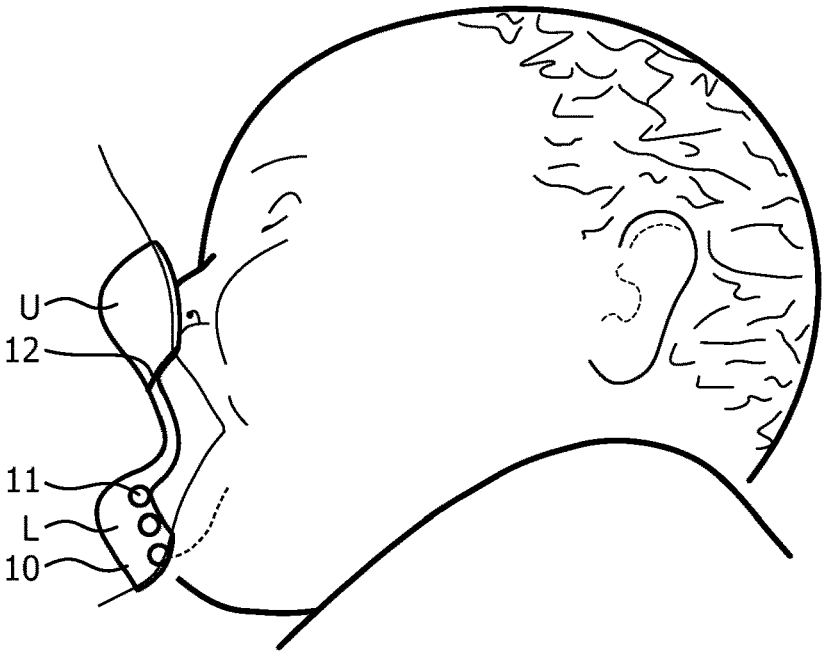
FIG. 2 shows an illustrative view of the device of FIG. 1 when it is worn on the breast of the breastfeeding mother who is feeding the baby.

FIG. 2 shows an illustrative view of the device 1 of FIG. 1 when it is worn on the breastfeeding mother's breast who is feeding the baby. The first element 10 comprises a lower portion L and an upper portion U. The lower portion L of the first element 10 is to be attached to the lower portion of the breast, which is the portion of the breast below the nipple, while the upper portion U of the first element 10 is to be attached to the upper portion of the breast, which is the portion of the breast above the nipple. When wearing the device 1, the breastfeeding mother attaches the lower portion L of the first element 10 to the lower portion of the breast, and attaches the upper portion U of the first element 10 to the upper portion of the breast.

According to an embodiment, the first marker 11 can be located on the lower portion L of the first element 10. The first marker 11 can be a plurality of protruding knobs, and the first marker 11 on the lower portion is used for indicating the position of the mother's breast for the baby's lower lip, as shown in FIG. 2.

In another embodiment, instead of being located on the lower portion of the first element 10, the first marker 11 (not shown in FIG. 2) can be located on the upper portion U of the first element 10 and is used for indicating the position of the mother's breast for the baby's upper lip.

In another embodiment, besides the first marker 11, the device 1 further comprises a second marker 12 located on a portion of the first element opposite to the portion where the first marker 11 is located, i.e. the first marker and the second marker extend in an up-down direction. In other words, the first marker 11 and the second marker 12 are located on the lower portion L and the upper portion U respectively of the first element 10 for indicating the positions of a mother's breast that the baby's lower lip and upper lip respectively are expected to contact. To be specific, for example, when the first marker 11 is located on the lower portion L of the first element 10, the device 1 further comprises a second marker 12 located on the upper portion U of the outer surface of the first element 10, and the second marker 12 indicates the position that the baby's upper lip should be close to.

As can be seen in FIG. 2, the marker on the upper portion U of the first element 10, for example the second marker 12, is a visible curved line, i.e. a visible marker; since the breastfeeding mother has a good view of the upper portion of her breast, the visible line is enough for indicating a position. And the marker on the lower portion of the first element 10, for example the first marker 11, takes the form of a plurality of tactile protruding knobs, i.e. a tactile marker, since the baby latching on the breast of the breastfeeding mother has covered the mother's sight; therefore, the mother has a poor view of this part, but she can touch the tactile protruding knobs.

In another embodiment, the marker on the upper portion U of the first element 10 can be a tactile marker, enabling the mother to touch also the marker on the upper portion U to determine whether the baby is latching on to the breast correctly. Therefore, when the marker on the upper portion is a tactile marker, the mother can determine whether the baby is latching on to the breast correctly by touching the marker; when the marker on the upper portion is a tactile marker or a visible marker, the mother can determine whether the baby is latching on to the breast correctly by touching or looking at the marker.

Of course, in addition to the form of the curved line shown in FIG. 2, also the form of the visible marker can be varied, for example, any pattern that can be used to indicate the position for the baby's upper lip against the mother's breast. And the tactile marker can also take various forms; for example, the tactile marker can be in the form of protruding knobs, a protruding rib, protruding dots, dents, recessed grooves, recessed dots, or the marker can be the area whose surface roughness is obviously different from that of other areas, so that the breastfeeding mother can easily touch and identify the marker. In an embodiment, the profile of the visible marker or the tactile marker suits the shape of the lips of the baby. The visible colored line suits the shape of the baby's upper lip and also the plurality of tactile protruding knobs are arranged so as to fit the shape of the baby's lower lip.

According to an experiment cited in "Anatomy of the lactating human breast redefined with ultrasound imaging", J. Anat. (2005)206, pp. 525-534, Anatomical Society of Great Britain and Ireland 2005, the areola radius is 27.8±5.5 mm and 25.6±5.5 mm for the left and the right breast, respectively. Therefore, the markers can be located along an arch with a radius of approximately 20 mm to 35 mm that is centered on the nipple, so that when the device 1 is worn on the breast of the breastfeeding mother, the marker is adjacent to the edge of the areola of the breast of the breastfeeding mother. Therefore, when the baby is latching on the breast of the breastfeeding mother, the baby's lip is instructed to cover most of the areola of the breast according to the marker.

In another embodiment, the distance from the marker on the upper portion U, for example second marker 12, to the nipple is shorter than the distance from the marker on the lower portion L, for example the first marker 11, to the nipple. It is suggested by the lactation consultant that the baby's mouth should cover the nipple, most of the areola and sometimes some of the breast tissue, slightly more at the bottom of the breast than at the top, so that the nipple of the breastfeeding mother can touch the baby's palate, and the baby's sucking activity is stimulated.

Figure 4:
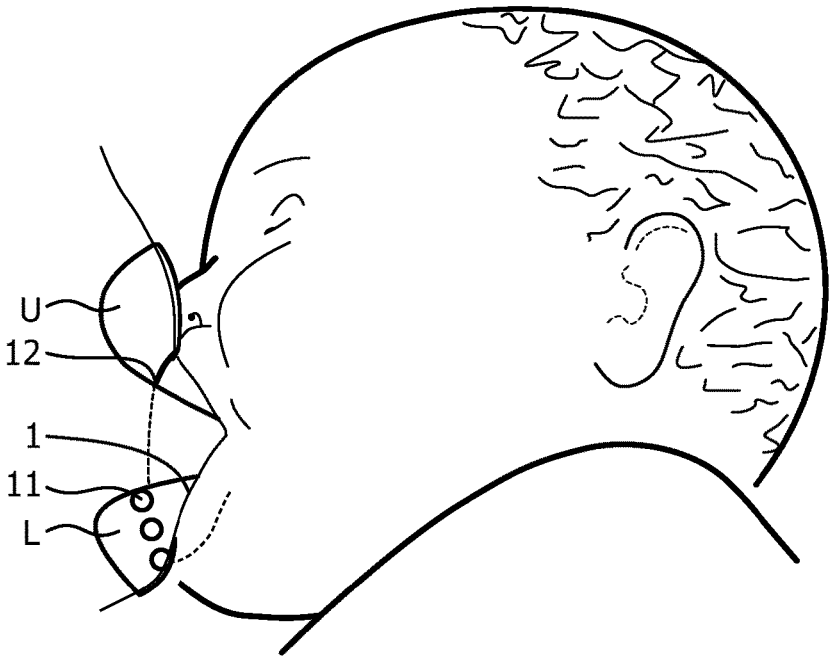
FIG. 4 shows an illustrative view of the device of FIG. 3 when it is worn on the breast of the breastfeeding mother who is feeding the baby.

In FIG. 2 and FIG. 4, the contour of device 1 is illustrated by means of a solid line, and the contour of the mother's breast is illustrated by means of a dashed line. Although the contour of device 1 and the contour of the mother's breast are shown as separate from each other in FIG. 2 and FIG. 4, those skilled in the art can understand that the device 1 can be pressed against the mother's breast, causing the two contours to overlap.

Figure 3:
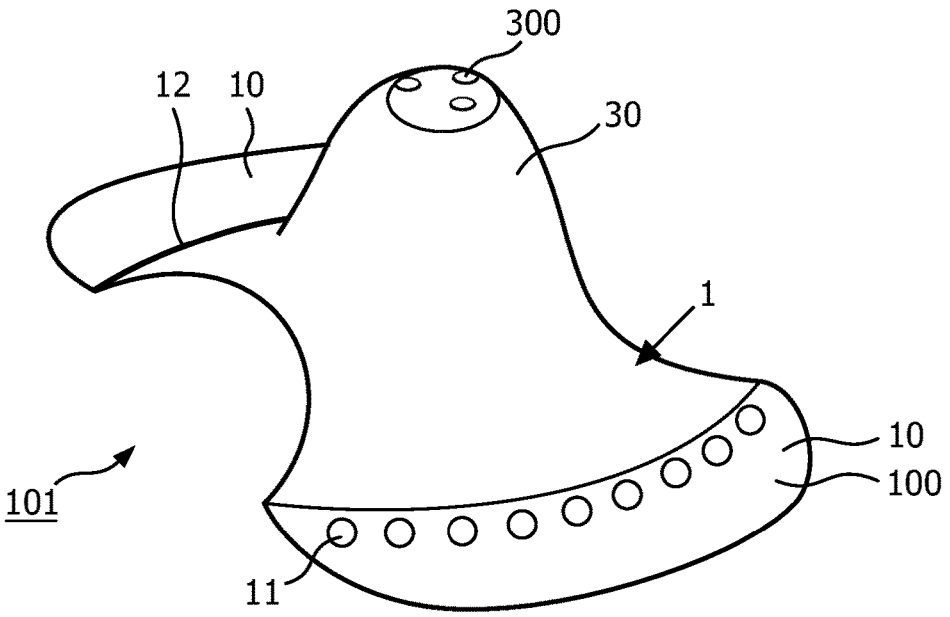
FIG. 3 shows a perspective view of the device according to another embodiment of the present invention.

FIG. 3 shows a perspective view of the device 1 according to another embodiment of the present invention.

In the embodiment, the device 1 further comprises a protruding portion 30 covering the nipple of the breast, and the protruding portion 30 has at least one aperture 300 for releasing breast milk. The protruding portion 30 has generally a funnel-shape which substantially fits the shape of the breastfeeding mother's nipple and part of the breast.

The device with protruding portion 30 has at least two functions. The first function is to protect the nipple of the breastfeeding mother, in which case, the device 1 could also be deemed a nipple protector with the function of guiding the baby to correctly latch-on. The second function of the protruding portion 30 is to guide the placing of the device 1 onto the mother's breast. The protruding portion 30 and the first element 10 could be an integral piece as shown in FIG. 3. The protruding portion 30 could also be detachable from the device 1, as will be further described with reference to FIG. 5.

FIG. 4 shows an illustrative view of the device of FIG. 3 when it is worn on the breast of the breastfeeding mother who is feeding the baby.

Figure 5:
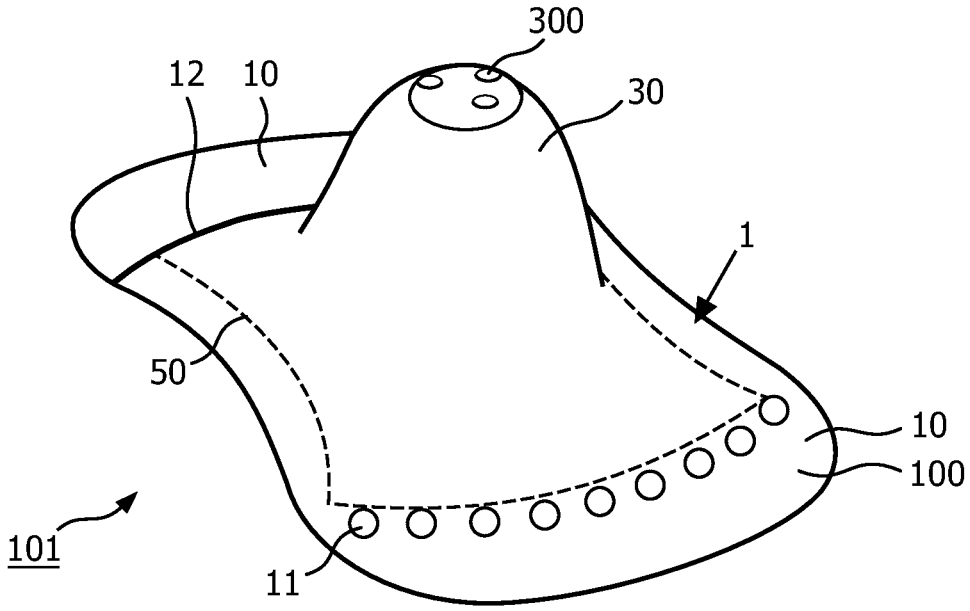
FIG. 5 shows a perspective view of the device according to another embodiment of the present invention, wherein the protruding portion is detachable from the device.

FIG. 5 shows a perspective view of the device according to yet another embodiment of the present invention, wherein the protruding portion is detachable from the device.

In FIG. 5, the protruding portion 30, which is surrounded by the dashed line 50, can be removed from the device 1 along the dashed line 50. When the protruding portion 30 is removed from the device 1 along the dashed line 50, the device 1 is similar to the device 1 shown in FIG. 1. Referring again to FIG. 1, it can be seen that the first element 10 is of a rectangular ring-like shape, with the first marker 11 and the second marker 12 respectively located on two opposing sides. To be specific, the first marker 11 is located on the lower portion L of the outer surface 100, and the second marker 12 is located on the upper portion U of the outer surface 100.

The protruding portion 30 can help the mother to properly place the device 1 and hence wear it in the proper position. When placing the device 1, the mother first wears the whole device 1 with the protruding portion 30 covering the mother's nipple. As a result, the first element 10 will be properly attached to the mother's breast and the marker will be located in the correct position. And after the device 1 is properly placed on the breast, the mother can remove the protruding portion 30 from the device 1. After the removal of the protruding portion 30 from the device 1, the baby can contact more of the tissue of the mother's real skin, which is a better stimulus to the breast of the breastfeeding mother and as a result the baby will get sufficient milk. Furthermore, the removal of the protruding portion can help the mother's skin to be more in contact with the air, making both the mother and the baby feel natural.

Of course, in the case that the mother has a sore or cracked nipple, she may not remove the protruding portion 30 from the device 1; in other words, the mother may wear the device 1 with the protruding portion 30 as if the protruding portion 30 and the first element 10 are in one piece, as shown in FIG. 2. Therefore, the protruding portion 30 can alleviate the soreness to the nipple because there is no direct contact between the nipple and the baby's mouth, i.e. the nipple is protected by the protruding portion 30.

The shape of the first element 10 is not limited to the above embodiments. For example, the first element 10 can also be fan-shaped or strip-shaped, rectangular-ring shaped etc. When the first element 10 is fan-shaped or strip-shaped, for example, when wearing the device 1, the mother is further provided with instructions on how to attach the device 1 to her breast. For example, when the first element 10 is strip-shaped, and the first marker 11 and/or the second marker 12 occupy most of the outer surface 100, the mother may be instructed to attach the marker 11 and/or marker 12 so as to be 25 to 30 mm away from the nipple, with one marker being situated below the nipple and the other marker being situated above the nipple in such a manner that they are aligned with the edge of the areola.

Figure 6:
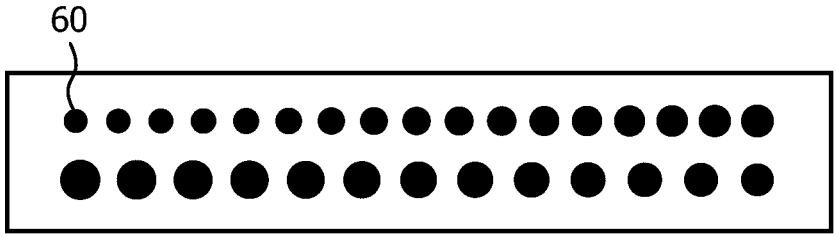
FIG. 6 is an illustrative ruler for aiding the mother to measure her nipple size.

In an embodiment, the device 1 is designed in different sizes to fit different sizes of different mothers' breasts and/or the sizes of different babies' mouths. When the size of a mother's breast is considered, a ruler for aiding the mother to measure her nipple size is provided. FIG. 6 is an illustrative view of a ruler for aiding the mother to measure her nipple size in order to choose a device 1 that is appropriate for her. Each of the plurality of dark apertures 60 has a different inner diameter, and the mother can use these apertures to measure her nipple size. For example, when her whole nipple can pass through a certain aperture, the inner diameter corresponding to said aperture 60 can be considered as the diameter of the mother's nipple. Since there is a general proportional ratio between the areola and the nipple, and the location of the marker is related to nipple and areola, the mother can choose a device 1 with an appropriate size according to the diameter of the nipple, using the ruler shown in FIG. 6. Those skilled in the art can understand that the ruler shown in FIG. 6 is for illustrative purposes only; the actual number and size of the apertures may differ according to different applications.

According to an embodiment, the device 1 further comprises a second element (not shown in the FIGS.) for attaching the first element 10 to the breast. The second element comprises a strap for attaching the first element 10 to the breast; the strap can be long enough to go around the back of the mother. Alternatively, two straps are provided respectively on the two opposing sides of the first element 10, and these two straps can meet at the mother's back to be joined together with buckles, so that the device 1 is held in place against the breast of the mother. Those skilled in the art can understand that the device 1 can be worn with the second element in a way similar to a bra, for example.

In another embodiment, the device 1 may have adhesive material on the inner surface 101 of the first element 10, so that the inner surface 101 can be attached to the breast by means of the adhesive material. The adhesive material can be silica gel, etc.

In another embodiment, the first element 10 of the device 1 is made of adhesive material, such as silicone, latex or plastic, so that the inner surface of the first element 1 can be attached to the surface of the mother's breast without a need for the second element. Such kind of material also has the advantage that it feels similar to the mother's real skin, and hence the baby will not have many difficulties suckling through the device 1. In another embodiment, the material of the device 1 is safe, for example, it can be the nipple of a milk bottle and it can be sterilized.

According to another aspect of the invention, a method is proposed that comprises a step of attaching a device 1 to a breast of a breastfeeding mother, the device 1 comprising a first marker 11, which first marker 11 is used for indicating a position of a mother's breast that the baby's lip is expected to contact in order to correctly hold the mother's breast.

It is to be understood that the term "contact" in the context of this invention does not mean actually "touch". According to different criteria, the meaning of "contact" could be that the baby's lip is expected to touch the position indicated by the marker, or it could mean that the baby's lip is expected to be close to the position indicated by the marker, i.e. within a certain distance thereof.

There are a plurality of criteria for indicating the position of a mother's breast that the baby's lip is expected to contact in order to correctly hold the mother's breast. For example, when the marker can neither be seen nor touched by the mother, it means the marker is completely in the baby's mouth and thus an indication that the baby is correctly sucking the mother's breast; or, when the marker can be seen or touched within a certain distance from the baby's lip, for example within a finger's distance from the baby's lip, it means that the baby is correctly holding the mother's breast; otherwise, when the marker can be seen or touched beyond a certain distance from the baby's lip, it can be determined that the baby is incorrectly sucking the mother's breast. Of course, with the different criteria, the distance between the marker and the nipple may vary, and those skilled in the art could design other criteria for indicating correctness of latch-on, based on the device and method proposed in the embodiment of the invention.

Although the above embodiments illustrate scenarios where a baby actually suckles the mother's breast, those skilled in the art can understand that an embodiment of the present invention can also serve an educational purpose. For example, an embodiment of the device 1 can be worn in front of the mirror by women in late pregnancy to learn what the correct baby latch-on position is according to the markers.

Those of ordinary skill in the art can understand and realize modifications to the disclosed embodiments, through studying the description, drawings and appended claims. All such modifications which do not depart from the spirit of the invention are intended to be included within the scope of the appended claims. The word "comprising" does not exclude the presence of elements or steps not listed in a claim or in the description. The word "a" or "an" preceding an element does not exclude the presence of a plurality of such elements. In the practice of the present invention, several technical features in the claim can be embodied by one component. In the claims, any reference signs placed between parentheses shall not be construed as limiting the claims.

What is claimed is:

1. A device comprising:

a first element, in the shape of a rectangular ring, the first element including an upper portion, a lower portion and two opposing curved shaped sides connecting the upper and lower portions, the first element configured to be attached to a breast of a breastfeeding mother, the upper portion being attachable to an upper portion of the breast above a nipple, the lower portion being attachable to a lower portion of the breast below the nipple;

wherein the upper and lower portions of the rectangular ring are separated by a central cavity having a length and width dimension comparable to the respective sides of the rectangular ring, a first marker shaped in the contour of a baby's lower lip to provide the breastfeeding mother with an accurate reference for determining the expected location of the baby's lip, the first marker comprising a plurality of protruding knobs or ribs located on an outer surface of the lower portion of the first element to indicate the position of the device that the baby's lower lip is expected to contact in order to correctly hold the mother's breast, a second marker located on an outer surface of the upper portion of the first element to indicate the position of the mother's breast that the baby's upper lip is expected to contact, wherein the first marker on the lower portion of the first element is a tactile marker which suits the shape of the baby's lower lip, wherein the first and second markers extend in an up-down direction, and wherein the distance from the marker on the upper portion to the nipple is shorter than the distance from the marker on the lower portion to the nipple, and wherein the first and second markers occupy most of the outer surfaces.

2. The device according to claim 1, wherein the second marker on the upper portion of the first element is a visible marker.

3. The device according to claim 1, wherein the first and second markers are located along an arch with a radius of approximately 20 mm to 35 mm from the center of the device.

4. The device according to claim 1, wherein the first element is fan-shaped.

5. The device according to claim 1, wherein the device further comprises a protruding portion configured for covering the nipple of the mother's breast, which protruding portion has at least one aperture for releasing breast milk.

6. The device according to claim 5, wherein the shape of the protruding portion fits the shape of the nipple of the mother's breast.

7. The device according to claim 5, wherein the protruding portion is detachable from the device.

8. The device according to claim 1, wherein the device further comprises: a second element configured for attaching the first element to the breast.

9. The device according to claim 1, wherein the first marker on the lower portion of the first element is a visible marker.

10. The device according to claim 9, wherein the visible marker comprises a colored line.

11. The device according to claim 1, wherein the first marker comprises an area whose surface roughness is different from a surface roughness of the roughness of the outer surfaces not occupied by the first and second marker.

* * * * *